US012808541B2

(12) United States Patent
Nath et al.

(10) Patent No.: US 12,808,541 B2
(45) Date of Patent: Nov. 24, 2026

(54) PILOT FUEL NOZZLE ASSEMBLY WITH MULTI-ANGLED VENTURI

(71) Applicant: General Electric Company, Schenectady, NY (US)

(72) Inventors: Hiranya Nath, Bengaluru (IN); Habeeb Kunnummal Manat, Bengaluru (IN); Hejie Li, Mason, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 255 days.

(21) Appl. No.: 18/438,977

(22) Filed: Feb. 12, 2024

(65) Prior Publication Data

US 2025/0257874 A1 Aug. 14, 2025

(51) Int. Cl.

| | |
|---|---|
| ***F23R 3/34*** | (2006.01) |
| ***F23R 3/14*** | (2006.01) |
| ***F23R 3/28*** | (2006.01) |

(52) U.S. Cl.

CPC ..... *F23R 3/343* (2013.01); *F23R 3/14* (2013.01); *F23R 3/286* (2013.01)

(58) Field of Classification Search

CPC ..... F23R 3/14; F23R 3/286; F23R 3/343

See application file for complete search history.

(56) References Cited

U.S. PATENT DOCUMENTS

| | | | | |
|---|---|---|---|---|
| 5,253,478 | A | 10/1993 | Thibault, Jr. et al. | |
| 6,389,815 | B1 * | 5/2002 | Hura | F23R 3/346 60/746 |
| 8,365,531 | B2 | 2/2013 | Pidcock et al. | |
| 9,512,805 | B2 | 12/2016 | Snyder | |
| 9,759,425 | B2 | 9/2017 | Westmoreland et al. | |
| 9,927,126 | B2 * | 3/2018 | Benjamin | F23D 11/14 |
| 10,054,312 | B2 | 8/2018 | Dai et al. | |
| 10,072,845 | B2 * | 9/2018 | Mook | B23P 6/005 |
| 10,712,008 | B2 | 7/2020 | Aurifeille et al. | |
| 11,149,948 | B2 | 10/2021 | Stevens et al. | |
| 2007/0028618 | A1 * | 2/2007 | Hsiao | F23R 3/343 60/737 |
| 2010/0162713 | A1 * | 7/2010 | Li | F23R 3/286 60/748 |
| 2010/0251719 | A1 | 10/2010 | Mancini et al. | |
| 2010/0263382 | A1 * | 10/2010 | Mancini | F23R 3/14 60/742 |
| 2010/0269506 | A1 * | 10/2010 | Nonaka | F23D 11/386 60/742 |

(Continued)

*Primary Examiner* — William H Rodriguez

(74) *Attorney, Agent, or Firm* — Venable LLP; Michele V. Frank

(57) ABSTRACT

A pilot fuel nozzle assembly includes a fuel nozzle, a swirler, and a vented pilot venturi. The vented pilot venturi has an annular wall with an oxidizer flow passage therein and a venturi expansion surface. The venturi expansion surface includes a plurality of conical surface segments extending circumferentially about the fuel nozzle centerline axis. At least two conical surface segments are joined together mechanically. One or more of the plurality of conical surface segments have a plurality of venturi oxidizer outlet ports extending through the venturi expansion surface. The plurality of venturi oxidizer outlet ports are circumferentially spaced about the fuel nozzle centerline axis.

20 Claims, 6 Drawing Sheets

(56) References Cited

U.S. PATENT DOCUMENTS

| | | | | |
|---|---|---|---|---|
| 2014/0090381 | A1* | 4/2014 | Rullaud | F23R 3/20<br>60/740 |
| 2015/0292743 | A1* | 10/2015 | Mook | F02C 7/18<br>29/889.22 |
| 2016/0265778 | A1* | 9/2016 | Patel | F23R 3/28 |
| 2016/0363320 | A1* | 12/2016 | Benjamin | F02C 7/22 |
| 2016/0363321 | A1* | 12/2016 | Benjamin | F23D 11/105 |
| 2022/0372913 | A1* | 11/2022 | Nath | F23R 3/286 |
| 2022/0373182 | A1 | 11/2022 | Nath et al. | |

* cited by examiner

PILOT FUEL NOZZLE ASSEMBLY WITH MULTI-ANGLED VENTURI

TECHNICAL FIELD

The present disclosure relates to a venturi of a pilot fuel nozzle assembly for a combustor of a gas turbine engine.

BACKGROUND

Some combustors in use are known as TAPS (Twin Annular Pre-mixing Swirler) combustors. TAPS combustors include a pre-mixer/swirler fuel nozzle assembly in which air and fuel are mixed. The TAPS pre-mixer/swirler fuel nozzle assembly includes both a pilot swirler and a main pre-mixer. The pilot swirler includes a venturi into which a fuel and air mixture is injected by a pilot fuel nozzle and surrounding air swirlers. The fuel and air mixture exits the venturi into a combustion chamber, where the fuel and air mixture is ignited and burned. At the outlet end of the venturi, a heat shield is generally provided to protect the fuel nozzle assembly. An aft surface of the heat shield facing the combustion chamber is subject to high temperatures from the burning fuel and air mixture exiting the venturi.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
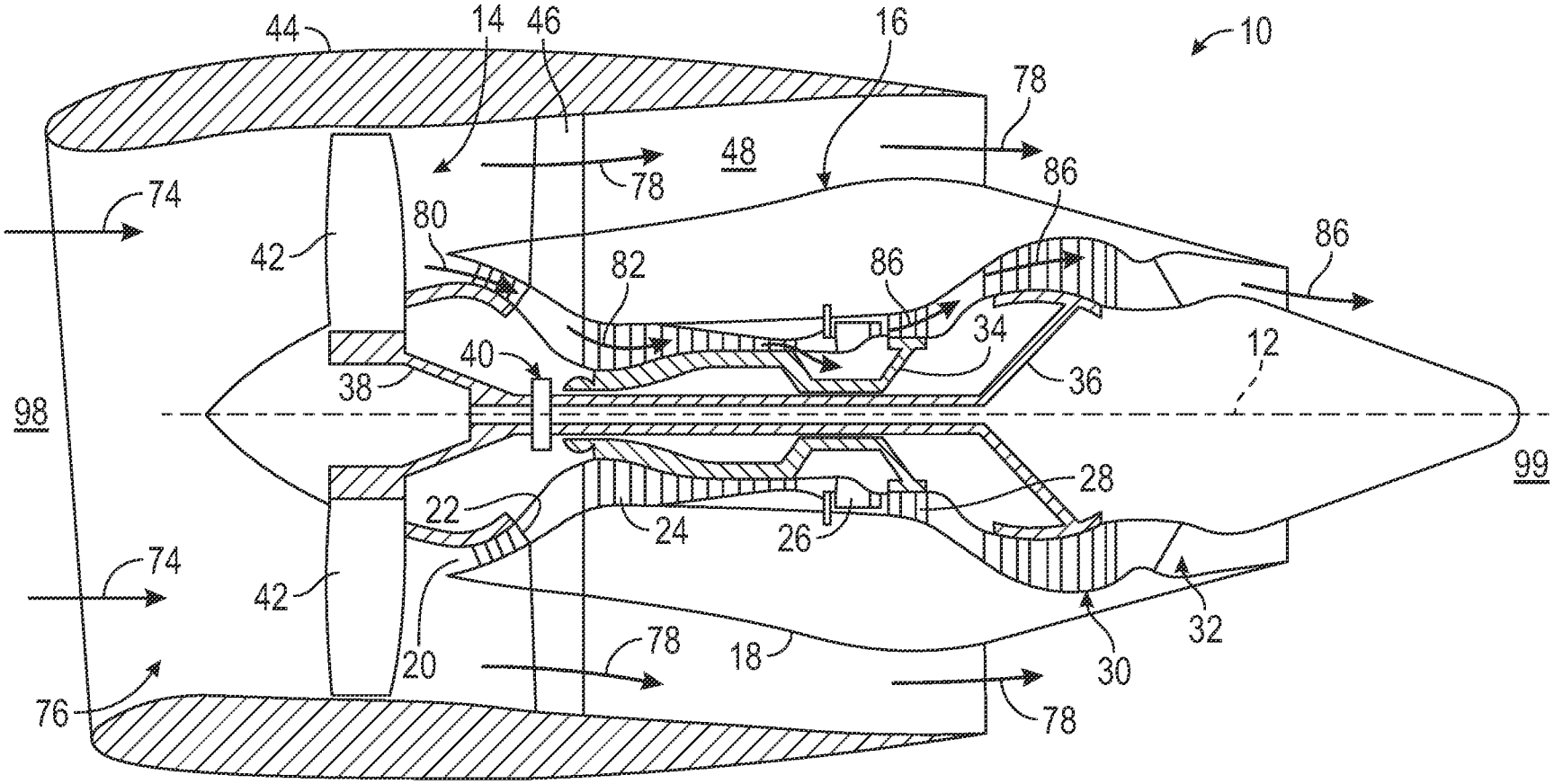
FIG. 1 is a schematic partial cross-sectional side view of an exemplary high by-pass turbofan jet engine, according to an embodiment of the present disclosure.

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the present disclosure.

As used herein, the terms "first," "second," and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The singular forms "a," "an," and "the" include plural references unless the context clearly dictates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially" is not to be limited to the precise value specified. In at least some instances, the approximating language may correspond to the precision of an instrument for measuring the value, or the precision of the methods or the machines for constructing or manufacturing the components and/or systems. For example, the approximating language may refer to being within a one, two, four, ten, fifteen, or twenty percent margin in either individual values, range(s) of values, and/or endpoints defining range(s) of values.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

TAPS combustors are known to include a fuel nozzle assembly that has a pilot swirler that includes a splitter and a venturi. The pilot swirler ejects a fuel and air mixture into the venturi, which then flows into a combustion chamber, where the fuel and air mixture is ignited and burned. At the outlet end of the venturi, a heat shield is generally provided to protect the fuel nozzle assembly. The heat shield conventionally includes a flange in which cooling air is provided to the forward surface to cool the flange, and some of the cooling air is also provided to the aft surface.

The present disclosure discusses a fuel nozzle architecture with a vented venturi feature. More specifically, the present disclosure provides for a vented venturi as part of the pilot fuel nozzle assembly, where the arrangement of the vented venturi reduces high temperatures on the venturi surface. According to the present disclosure, the vented venturi has an air flow passage within a venturi wall and a plurality of rows of oxidizer outlet ports that extend through the wall of the venturi from the air flow passage to the inner surface of the venturi. The flow of an oxidizer within the air flow passage and through the oxidizer outlet ports provides cooling air to the inner surface of the venturi, and also to an outer end portion of the venturi. The oxidizer outlet ports are circumferentially spaced in a circumferential direction about a circumference of the venturi inner surface, and about the circumference of the outlet end of the venturi.

To address the vulnerability of the aft heat shield of the fuel nozzle assembly to oxidation that reduces the durability of the fuel nozzle assembly, the heat shield area is minimized and the shape and the design of the wall of the venturi is tailored to reduce wall gas temperature while retaining the overall flow structure. The venturi can be made of a single part or can be made of a number of segments that are joined together and arranged at various angles. The venturi has a plurality of holes. One or more segments of the venturi is provided with a row of cooling holes. One or more segments of the venturi may not have cooling holes.

Referring now to the drawings, FIG. 1 is a schematic partial cross-sectional side view of an exemplary high by-pass turbofan jet engine 10, herein referred to as "engine 10," according to an embodiment of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal centerline axis 12 that extends therethrough from an upstream end 98 to a downstream end 99 for reference purposes. In general, engine 10 may include a fan assembly 14 and a turbo-engine 16 disposed downstream from the fan assembly 14.

The turbo-engine 16 may generally include a substantially tubular outer casing 18 that defines an annular inlet 20. The outer casing 18 encases or at least partially forms, in serial flow relationship, a compressor section having a booster or a low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration. In other embodiments, although not illustrated, the engine 10 may further include an intermediate pressure (IP) compressor and a turbine rotatable with an intermediate pressure shaft (not shown).

As shown in FIG. 1, the fan assembly 14 includes a plurality of fan blades 42 that are coupled to and that extend radially outwardly from the fan shaft 38. An annular fan casing or a nacelle 44 circumferentially surrounds the fan assembly 14 and/or at least a portion of the turbo engine 16. In one embodiment, the nacelle 44 may be supported relative to the turbo-engine 16 by a plurality of circumferentially spaced outlet guide vanes or struts 46. Moreover, at least a portion of the nacelle 44 may extend over an outer portion of the turbo-engine 16 so as to define a bypass airflow passage 48 therebetween.

Figure 2:
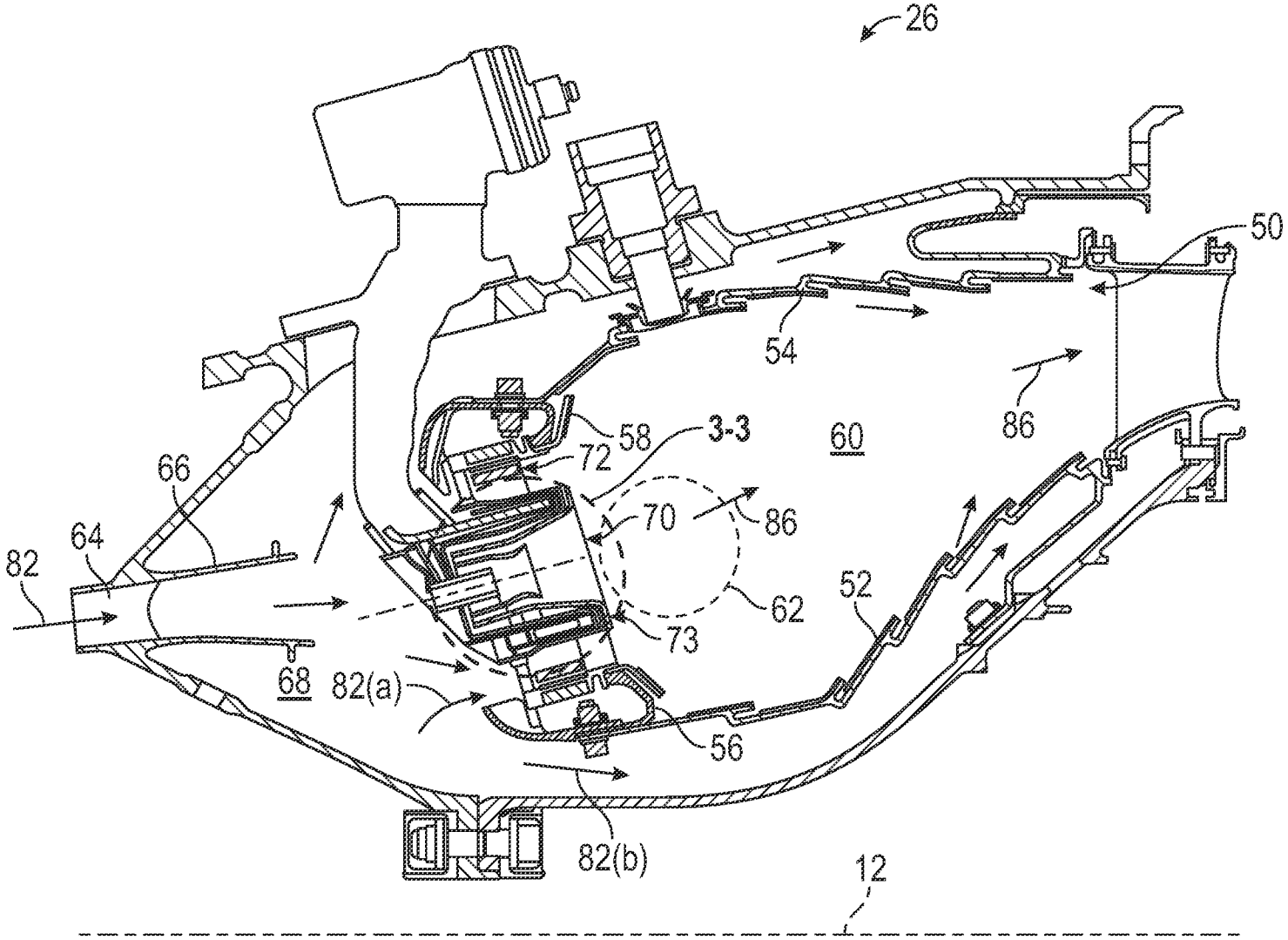
FIG. 2 is a partial cross-sectional side view of an exemplary combustion section, according to an embodiment of the present disclosure.

FIG. 2 is a partial cross-sectional side view of an exemplary combustion section 26 of the turbo-engine 16 shown in FIG. 1, according to an embodiment of the present disclosure. The combustion section 26 in FIG. 2 is depicted as an exemplary Twin Annular Pre-mixing Swirler (TAPS) type combustor section. The present disclosure can be implemented in other combustor types, so the TAPS combustion section is merely exemplary. As shown in FIG. 2, the combustion section 26 may generally include a combustor assembly 50 (e.g., an annular type combustor assembly) having an annular inner liner 52, an annular outer liner 54, a bulkhead wall 56, and a dome assembly 58, together defining a combustion chamber 60. The combustion chamber 60 may more specifically define a region defining a primary combustion zone 62 at which initial chemical reaction of a fuel-oxidizer mixture and/or recirculation of combustion gases 86 may occur before flowing further downstream, where mixture and/or recirculation of combustion products and air may occur before flowing to the HP turbine 28 and the LP turbine 30. The combustor assembly 50 also includes a pilot fuel nozzle assembly 70 that has a pilot fuel nozzle portion 73 and a main pre-mixer portion 72. As will be described below, the pilot fuel nozzle portion 73 includes a pilot fuel nozzle and pilot air swirlers that produce a swirled pilot fuel and air mixture that is ejected into a pilot venturi, and then into the combustion chamber 60, where the swirled pilot fuel and air mixture is burned to produce combustion gases 86. The pilot fuel nozzle portion 73 generally operates at all operating conditions of the engine 10. The main pre-mixer portion 72 has main fuel nozzles and main air swirlers that produce a main fuel and air mixture that is ejected into the combustion chamber 60, where the main fuel and air mixture is also ignited and burned. The main pre-mixer portion 72 generally operates at higher power operations of the engine 10 (e.g., during a take-off phase or a cruising phase).

During operation of the engine 10, as shown in FIGS. 1 and 2 collectively, a volume of air, as indicated schematically by arrows 74, enters the engine 10 from upstream end 98 through an associated inlet 76 of the nacelle 44 and/or fan assembly 14. As the inlet air 74 passes across the fan blades 42, a portion of the air as indicated schematically by arrows 78 is directed or routed into the bypass airflow passage 48, while another portion of the air, as indicated schematically by arrow 80, is directed or routed into the LP compressor 22. Air portion 80 is progressively compressed as it flows through the LP compressor 22 and HP compressor 24 towards the combustion section 26. As shown in FIG. 2, the now compressed air, as indicated schematically by arrow 82, flows across a compressor exit guide vane (CEGV) 64 and through a pre-diffuser 66 into a diffuser cavity 68 of the combustion section 26.

The compressed air 82 pressurizes the diffuser cavity 68. A first portion of the compressed air 82, as indicated schematically by arrows 82(*a*), flows from the diffuser cavity 68 into the pilot fuel nozzle assembly 70, where the first portion of the compressed air 82 is premixed with fuel and ejected from pilot fuel nozzle assembly 70 and burned, thus generating combustion gases, as indicated schematically by arrows 86, within the primary combustion zone 62 of the combustor assembly 50. Typically, the LP compressor 22 and HP compressor 24 provide more compressed air to the diffuser cavity 84 than is needed for combustion. Therefore, a second portion of the compressed air 82, as indicated schematically by arrows 82(*b*), may be used for various purposes other than combustion.

Referring back to FIGS. 1 and 2 collectively, the combustion gases 86 generated in the combustion chamber 60 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the turbo-engine 16 to provide propulsive at downstream end 99.

Figure 3:
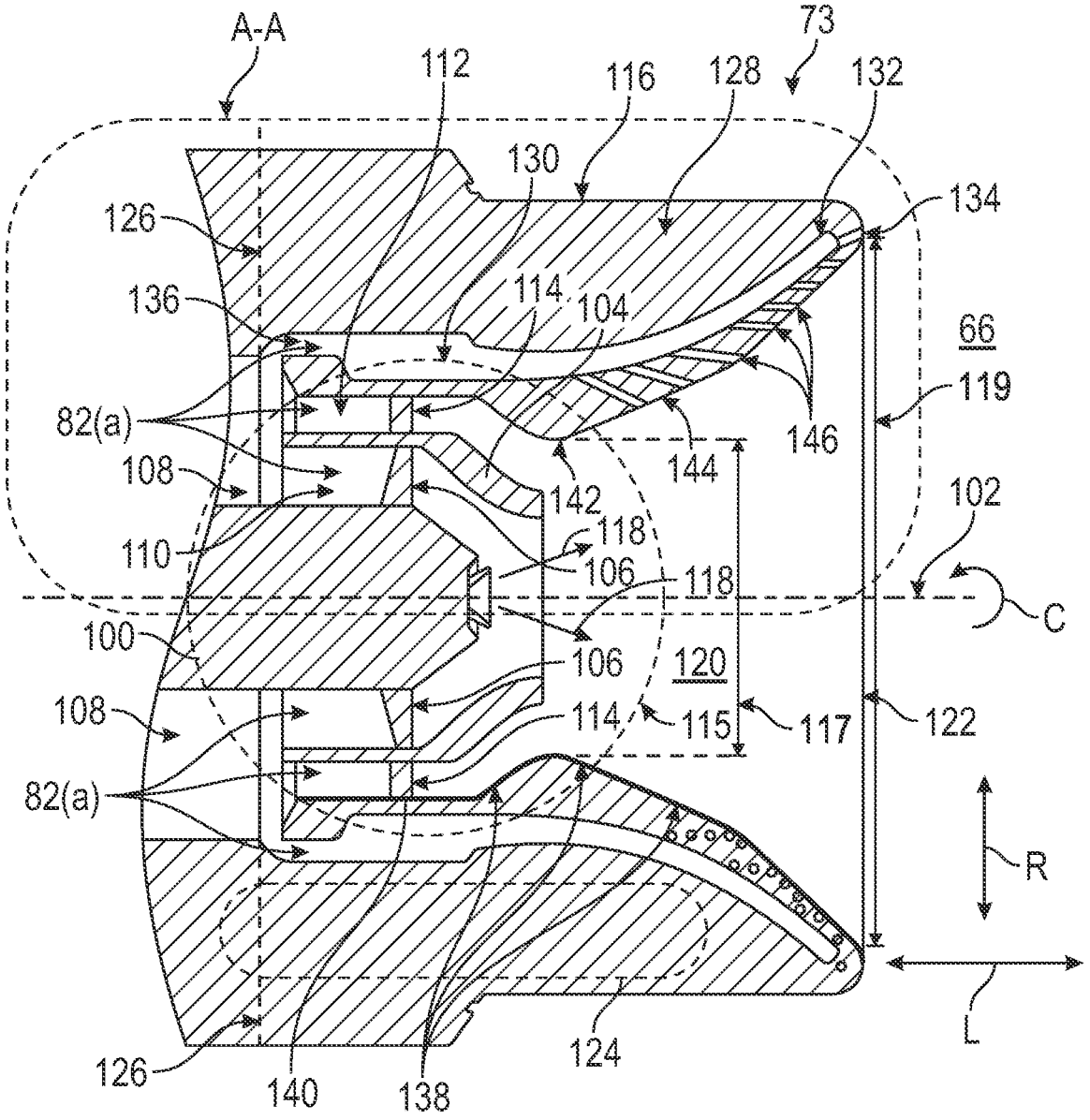
FIG. 3 is a partial cross-sectional side view of an exemplary pilot fuel nozzle assembly, according to an embodiment of the present disclosure.

FIG. 3 is a partial cross-sectional side view of an exemplary pilot fuel nozzle portion 73, taken at detail 3-3 in FIG. 2, according to an embodiment of the present disclosure. In FIG. 2, the pilot fuel nozzle assembly 70 includes both the pilot fuel nozzle portion 73 and the main pre-mixer portion 72 attached thereto. The main pre-mixer portion 72 is not depicted in FIG. 3 and only the pilot fuel nozzle portion 73 is depicted therein. The pilot fuel nozzle portion 73 includes a pilot oxidizer inlet 108 and a pilot fuel nozzle 100 aligned along a longitudinal centerline axis 102 (venturi centerline axis). In FIG. 3, the pilot fuel nozzle 100 is merely shown as a general representation of a pilot fuel nozzle and internal component parts, such as a fuel line, etc., that are known to be part of a pilot fuel nozzle in a TAPS-type pilot fuel nozzle, are not shown in FIG. 3, for the sake of clarity.

The pilot fuel nozzle 100 is surrounded by a pilot splitter 104, which is separated from the pilot fuel nozzle 100 by a pilot inner air passage 110. Positioned within the pilot inner air passage 110 are inner air passage swirl vanes 106. Surrounding the pilot splitter 104 is a vented pilot venturi 116, which will be described in more detail in the following paragraphs. A pilot outer air passage 112 is formed between the pilot splitter 104 and the vented pilot venturi 116, with outer air passage swirl vanes 114 disposed within the pilot outer air passage 112. In operation, air 82(*a*) enters the pilot oxidizer inlet 108, and the flow of the air 82(*a*) is separated by the pilot splitter 104 between the pilot inner air passage 110 and the pilot outer air passage 112. A swirl is induced into the air 82(*a*) flowing through the pilot inner air passage 110 and the pilot outer air passage 112 by the inner air passage swirl vanes 106 and the outer air passage swirl vanes 114. Thus, the pilot splitter 104, the inner air passage swirl vanes 106, and the outer air passage swirl vanes 114, function as a pilot oxidizer swirler 115 (indicated by a dotted circle in FIG. 3). The swirled airflow mixes with fuel 118 (shown as arrows) ejected from the pilot fuel nozzle 100 in an open cavity portion 120 of the vented pilot venturi 116 to produce a swirled fuel and air mixture (not shown). The swirled fuel and air mixture is generally swirled circumferentially (C) about the open cavity portion 120 (i.e., swirled in a pilot swirl direction). The swirled fuel and air mixture within the open cavity portion 120 flows toward an outlet 122 of the vented pilot venturi 116, where the swirled fuel and air mixture is ignited and burned within the combustion chamber 60.

The vented pilot venturi 116 will now be described in more detail. The vented pilot venturi 116, depicted in the drawings, omits some elements that may be included as part of the pilot fuel nozzle assembly 70 that are not necessary for an understanding of the vented pilot venturi 116. In particular, while the cross section of FIG. 3 depicts a generally solid area around the outer portion of the venturi (e.g., area 124), the area 124 may include elements such as a main fuel circuit and a main air flow passage that form a part of the main pre-mixer portion 72. Such main fuel circuits and main air flow passages that form part of TAPS-type pre-mixer are known to those skilled in the art.

In FIG. 3, the vented pilot venturi 116 is seen to be formed of a generally annular wall 128 that extends, in the longitudinal direction (L), along the longitudinal centerline axis 102 from an inlet end 126 to the outlet 122. The vented pilot venturi 116 also extends circumferentially about the longitudinal centerline axis 102. The annular wall 128 includes an oxidizer flow passage 130 within the annular wall 128. The oxidizer flow passage 130 extends from the inlet end 126 of the vented pilot venturi 116 to an outlet end 132 of the vented pilot venturi 116 adjacent to the outlet 122. That is, the oxidizer flow passage 130 terminates within the annular wall 128 prior to the outlet 122 near a rounded outlet tip portion 134. The oxidizer flow passage 130 is in fluid communication with the pilot oxidizer inlet 108. That is, the inlet end of the vented pilot venturi 116 includes a flow passage inlet 136 in which the air 82(*a*) from the pilot oxidizer inlet 108 can enter the oxidizer flow passage 130.

The annular wall 128 further defines an inner venturi surface 138 that extends from the inlet end 126 of the venturi to the outlet 122 of the venturi, and the inner venturi surface 138 defines, at least in part, the open cavity portion 120 through the vented pilot venturi 116. The inner venturi surface 138 (depicted in bold for emphasis in FIG. 3) extends circumferentially about the longitudinal centerline axis 102. The inner venturi surface 138 can generally be seen to include an upstream portion 140 that forms an outer surface of the pilot outer air passage 112, a throat area 142, and a venturi expansion surface 144 downstream of the throat area 142. Thus, the throat area 142 is disposed between the inlet end 126 of the vented pilot venturi 116 and the outlet 122 of the vented pilot venturi 116. The throat area 142 can be seen to have a first diameter 117 less than a remaining portion of the venturi expansion surface 144 downstream of the throat area. That is, the venturi expansion surface 144 can be seen to be an expansion flow surface portion that expands in diameter as the inner venturi surface 138 progresses from the throat area 142 to the outlet 122. Accordingly, the venturi expansion surface 144, from the throat area 142 to the outlet 122 of the vented pilot venturi 116, includes the first diameter 117 at the throat area and a second diameter 119 at the outlet 122, where the second diameter 119 at the outlet 122 is greater than the first diameter 117 at the throat area 142.

The annular wall 128 further defines a plurality of oxidizer outlet ports 146. The oxidizer outlet ports 146 extend from the oxidizer flow passage 130 through the venturi expansion surface 144. Thus, the oxidizer outlet ports 146 are holes that allow the air 82(*a*) flowing through the oxidizer flow passage 130 in the annular wall to flow through the holes and into the open cavity portion 120. The oxidizer outlet ports 146 will be described in more detail below, but the plurality of oxidizer outlet ports 146 can be circumferentially spaced in the circumferential direction (C) about the longitudinal centerline axis 102.

Figure 4:
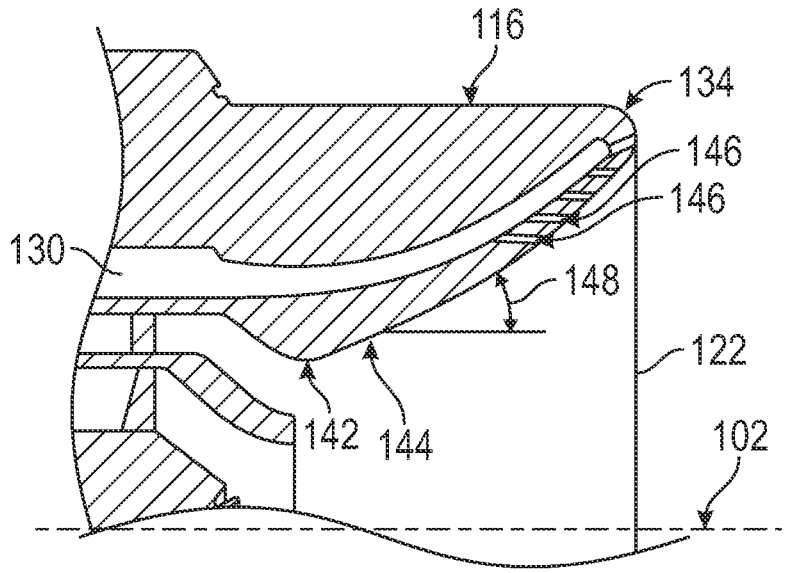
FIG. 4 is a partial cross-sectional side of a portion of the fuel nozzle in FIG. 3 showing a venturi expansion surface of a vented pilot venturi of the pilot fuel nozzle assembly having a generally curved profile shape, according to an embodiment of the present disclosure.

FIG. 4 shows the venturi expansion surface 144 as having a generally curved profile shape extending from the throat area 142 to the outlet 122. Alternatively, the venturi expansion surface 144 may be generally a conical-shaped portion (i.e., a conical-shaped surface) extending from the throat area 142 to the outlet 122. A half-angle 148 of the venturi expansion surface 144 (e.g., a single conical-shaped venturi expansion surface) may have a range from fifteen degrees to forty degrees. Of course, the present disclosure is not limited to the foregoing range and other half-angles may be implemented instead.

Figure 5:
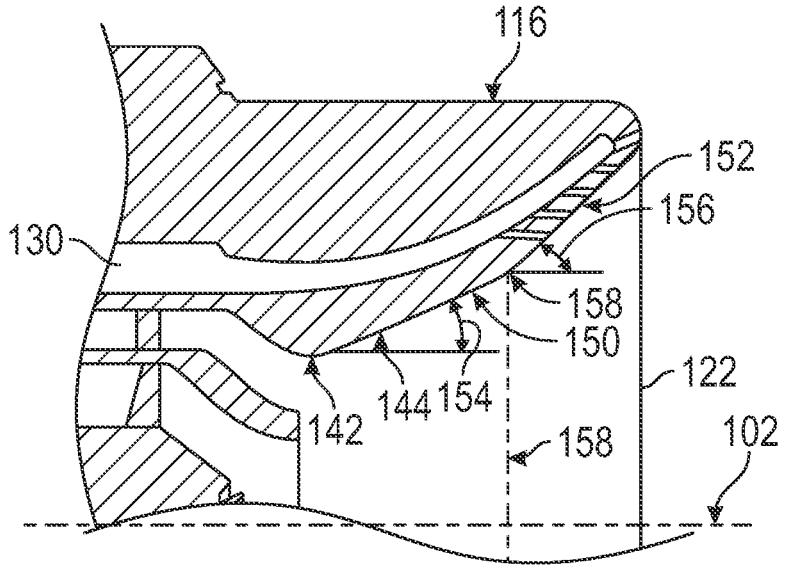
FIG. 5 is a partial cross-sectional side detail view of a portion of the fuel nozzle in FIG. 3 showing a venturi expansion surface of the vented pilot venturi of the pilot fuel nozzle assembly that is a double-angled surface, according to another embodiment of the present disclosure.

FIG. 5 depicts a venturi expansion surface 144 that is a double-angled surface, according to an embodiment of the present disclosure. That is, a first conical surface segment 150 of the venturi expansion surface 144 may be a generally conical-shaped surface that extends from the throat area 142 to a breakpoint 158 along the first conical surface segment 150. The first conical surface segment 150 may have a first conical half-angle 154. A second conical surface segment 152 of the venturi expansion surface 144 may also be a generally conical-shaped surface that extends from the breakpoint 158 to the outlet 122. The second conical surface segment 152 may have a second conical half-angle 156. In one aspect, the first conical half-angle may range from fifteen to thirty degrees, while the second conical half-angle may range from thirty to forty degrees. In another aspect, the first conical half-angle may range from thirty to forty degrees, while the second conical half-angle may range from fifteen to thirty degrees. Of course, the present disclosure is not limited to the foregoing ranges and other half-angles could be implemented instead. In addition, the expansion surface of the present disclosure is not limited to only two conical surfaces, and other arrangements may be implemented instead. For example, the first conical surface segment 150 may be implemented to the breakpoint 158, and a curved surface implemented downstream of the breakpoint. Alternatively, a curved surface may be implemented in place of the first conical surface segment 150 to the breakpoint 158, and then the second conical surface segment 152 may be included from the breakpoint 158 to the outlet 122. In addition, the present disclosure is not limited to dividing the venturi expansion surface 144 into two portions, but more than two portions could be implemented. For example, three conical surface portions could be implemented, where two separate breakpoints would be present between the conical surfaces.

Figure 6:
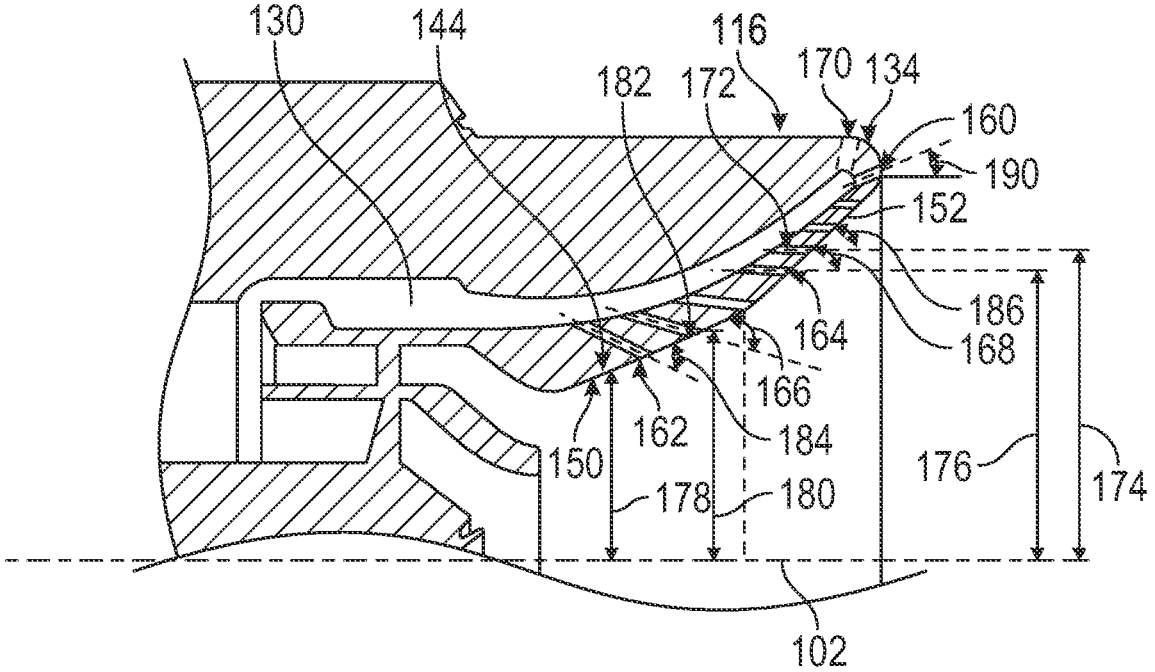
FIG. 6 is a partial cross-sectional side detail view of a portion of the fuel nozzle in FIG. 3, taken at detail A-A in FIG. 3 showing an arrangement of oxidizer outlet ports shown in FIG. 3, according to another embodiment of the present disclosure.

FIG. 6 is an enlarged view taken at detail A-A in FIG. 3, depicting an arrangement of the oxidizer outlet ports 146 shown in FIG. 3. FIG. 6 shows the double-angled venturi expansion surface 144 having the arrangement of the oxidizer outlet ports 146. Thus, the arrangement of the oxidizer outlet ports 146 with respect to the double-angled expansion surface will be described. The first conical surface segment 150 is seen to include oxidizer outlet ports 162 and 182 (corresponding to the oxidizer outlet ports 146 of FIG. 3). Each of the oxidizer outlet ports 162 and 182 extends from the oxidizer flow passage 130 through the first conical surface segment 150. In the vented venturi of the present disclosure, a plurality of the oxidizer outlet ports 162 are arranged about the circumference of the first conical surface segment 150, and a plurality of the oxidizer outlet ports 182 are arranged about the circumference of the first conical surface segment 150. The plurality of oxidizer outlet ports 162 arranged about the circumference of the first conical surface segment 150 may be referred to as a first row of oxidizer outlet ports, and the plurality of oxidizer outlet ports 182 arranged about the circumference of the first conical surface segment 150 can be referred to as a second row of oxidizer outlet ports. Collectively, the first row of oxidizer outlet ports 162 and the second row of oxidizer outlet ports 182 may be referred to as a first group of oxidizer outlet ports. In FIG. 6, the first row of oxidizer outlet ports 162 can be arranged at a radial distance 178 from the longitudinal centerline axis 102, while the second row of oxidizer outlet ports 182 can be seen to be arranged at a radial distance 180 different from the radial distance 178.

The oxidizer outlet port 162 can be aligned at an angle 184 with respect to the first conical surface segment 150, in the longitudinal direction (L). The oxidizer outlet port 182 can be aligned at an angle 166 with respect to the first conical surface segment 150, in the longitudinal direction (L). The angles 184 and 166 may be the same, or they may be different from one another. In some aspects of the present disclosure, the angles 184 and 166 may have a range from twelve degrees to thirty degrees. Of course, the present disclosure is not limited to the foregoing range and the angles 184 and 166 may be arranged at other angles instead.

The second conical surface segment 152 is seen to include oxidizer outlet ports 164 and 172 (again, corresponding to the oxidizer outlet ports 146 of FIG. 3). Each of the oxidizer outlet ports 164 and 172 extends from the oxidizer flow passage 130 through the second conical surface segment 152. In the vented venturi of the present disclosure, a plurality of the oxidizer outlet ports 164 are arranged about the circumference of the second conical surface segment 152, and a plurality of the oxidizer outlet ports 172 are arranged about the circumference of the second conical surface segment 152. The plurality of oxidizer outlet ports 164 arranged about the circumference of the second conical surface segment 152 may be referred to as a third row of oxidizer outlet ports, and the plurality of oxidizer outlet ports 172 arranged about the circumference of the second conical surface segment 152 may be referred to as a fourth row of oxidizer outlet ports. Collectively, the third row of oxidizer outlet ports 164 and the fourth row of oxidizer outlet ports 172 may be referred to as a second group of oxidizer outlet ports. In FIG. 6, the third row of oxidizer outlet ports 164 can be seen to be arranged at a radial distance 176 from the longitudinal centerline axis 102, while the fourth row of oxidizer outlet ports 172 can be seen to be arranged at a radial distance 174 different from the radial distance 176.

The oxidizer outlet port 164 can be aligned at an angle 168 with respect to the second conical surface segment 152, in the longitudinal direction (L). The oxidizer outlet port 172 is seen to be aligned at an angle 186 with respect to the second conical surface segment 152, in the longitudinal direction (L). The angles 168 and 186 may be the same, or may be different from one another. In some aspects of the present disclosure, the angles 168 and 186 may have a range from twelve degrees to thirty degrees. Of course, the present disclosure is not limited to the foregoing range and other angles may be implemented instead.

In FIG. 6, the rounded outlet tip portion 134 is seen to include a tip oxidizer outlet port 160. The tip oxidizer outlet port 160 extends from the oxidizer flow passage 130 through the rounded outlet tip portion 134. The tip oxidizer outlet port 160 is seen to be aligned at an angle 190 with respect to the longitudinal centerline axis 102, where the angle 190 extends radially outward and aft. Similar to the oxidizer outlet ports 164, 172, the angle 190 of the tip oxidizer outlet port may range from twelve to thirty degrees. Of course, the present disclosure is not limited to a tip oxidizer outlet port 160 at the rounded outlet tip portion 134, and, as shown in FIG. 6, a second tip oxidizer outlet port 170 may be included. Additional tip oxidizer outlet ports may also be included, depending on the cooling effect to be achieved. Of course, the present disclosure is not limited to the foregoing range and the angle 190 may be arranged at other angles instead.

Figure 7:
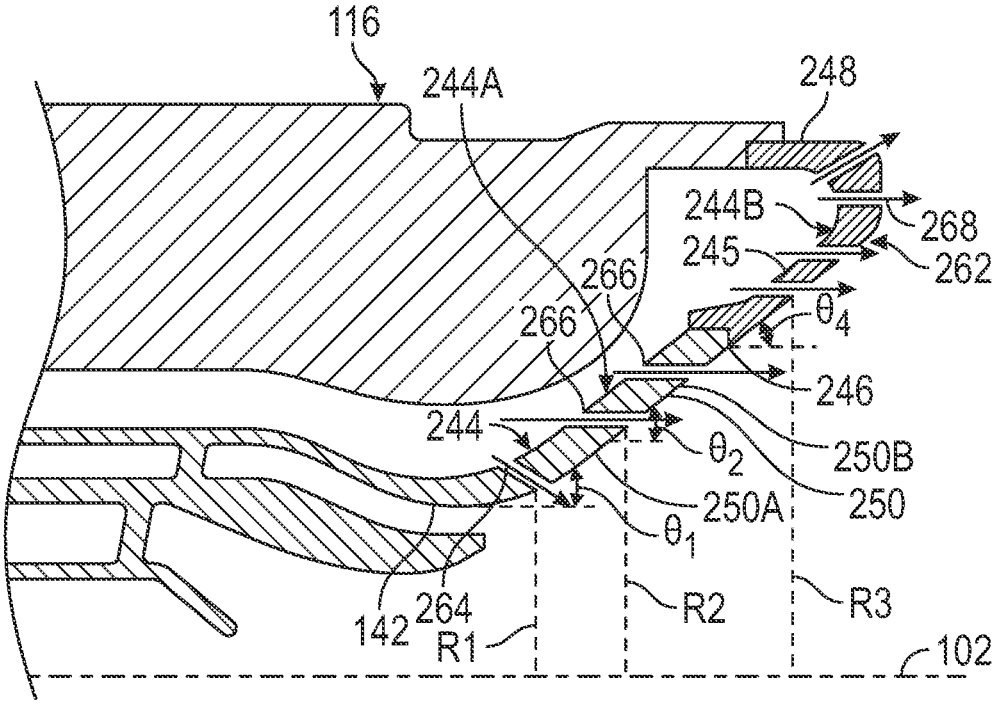
FIG. 7 is a cross-sectional side detail view of a portion of a fuel nozzle showing a venturi expansion surface of a vented pilot venturi of the pilot fuel nozzle assembly, according to another embodiment of the present disclosure.
Figure 8:
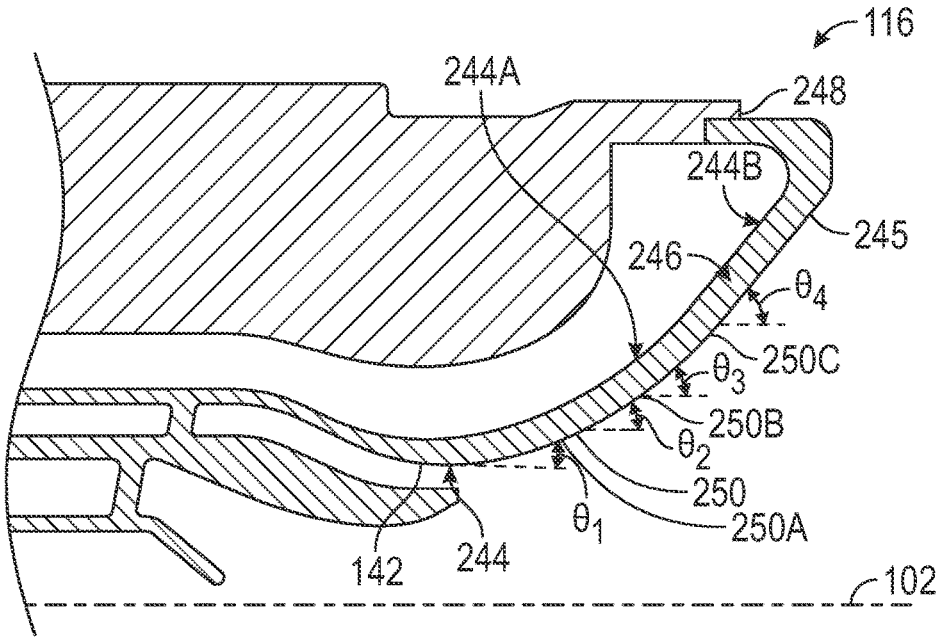
FIG. 8 is a cross-sectional side detail view of a portion of a fuel nozzle showing a venturi expansion surface of the vented pilot venturi of the pilot fuel nozzle assembly, according to yet another embodiment of the present disclosure.

FIGS. 7 and 8 show a venturi expansion surface 244 of the vented pilot venturi 116, according to another embodiment of the present disclosure. As shown in FIG. 7 and FIG. 8, the venturi expansion surface 244 has a first venturi expansion surface portion 244A and a second venturi expansion surface portion 244B. The first venturi expansion surface portion 244A extends from the throat area 142 to a breakpoint 246 (e.g., a joint point) along the venturi expansion surface 244. The second venturi expansion surface portion 244B extends from the breakpoint 246 to a tip portion 248 of the vented pilot venturi 116. The first venturi expansion surface portion 244A is mechanically joined (e.g., soldered, brazed, welded, or linked) to the second venturi expansion surface portion 244B at the breakpoint 246. For example, as shown in FIG. 7, the second venturi expansion surface portion 244B has a square edge at the breakpoint 246 for mating with a corresponding square edge of the first venturi expansion surface portion 244A. The tip portion 248 of the vented pilot venturi is located radially outward rom the longitudinal centerline axis 102 than the breakpoint 246. The first venturi expansion surface portion 244A is located at a first radial distance to the longitudinal centerline axis 102 and the second venturi expansion surface portion 244B is located at a second radial distance to the longitudinal centerline axis 102 greater than the first radial distance. The second venturi expansion surface portion 244B is formed from a single segment made from a unitary material that is selected to withstand combustion temperatures. The first venturi expansion surface portion 244A is formed from one or more surface segments. As shown in FIG. 7 and FIG. 8, the first venturi expansion surface portion 244A has a plurality of conical surface segments 250. The plurality of conical surface segments 250 form circumferential conical annular surfaces around the longitudinal centerline axis 102. FIG. 7 illustrates at least two of the plurality of conical surface segments 250 joined mechanically together in series. The term "in series" is used herein to mean that an end of one conical surface segment is connected to an adjacent or next conical surface segment, which, in turn, is connected to yet another adjacent or a next conical surface segment, etc. In an embodiment, the plurality of conical surface segments 250 are separate pieces joined together using any joining technique. An example of joining technique includes soldering, brazing, or welding the plurality of conical surface segments 250. Another example of joining technique includes adhesive bonding or chemical joining. In an embodiment, the plurality of conical surface segments 250 can be made from a same material or different materials. In another embodiment, at least two of the plurality of conical surface segments 250 can be made as a single unitary piece of a same material. In an embodiment, as will be described in further detail in the following paragraphs, the plurality of conical surface segments 250 are angled relative to each other and relative to the longitudinal centerline axis 102. Any number of conical surface segments 250 can be used. When the number of conical surface segments 250 is relatively high, for example, greater than ten, the first venturi expansion surface portion 244A can be said to be continuously varying in shape, and edges between the conical surface segments are smoothed.

FIG. 7 shows the first venturi expansion surface portion 244A having two surface segments, a first conical surface segment 250A and a second conical surface segment 250B. For example, the two conical surface segments 250A and 250B are discussed herein for the sake of explanation and illustration. However, any number of conical surface segments can be used. The first conical surface segment 250A defines a first conical half-angle $\theta_1$ relative to the longitudinal centerline axis 102. The second conical surface segment 250B defines a second conical half-angle $\theta_2$ relative to the longitudinal centerline axis 102. The first conical surface segment 250A and the second conical surface segment 250B are joined together such that an end of the first conical surface segment is connected to an end of the second conical surface segment.

FIG. 8 shows the first venturi expansion surface portion 244A having three surface segments, a first conical surface segment 250A, a second conical surface segment 250B, and a third conical surface segment 250C. The first conical surface segment 250A defines a first conical half-angle $\theta_1$ relative to the longitudinal centerline axis 102. The second conical surface segment 250B defines a second conical half-angle $\theta_2$ relative to the longitudinal centerline axis 102. The third conical surface segment 250C defines a third conical half-angle $\theta_3$ relative to the longitudinal centerline axis 102. Although two and three surface segments are depicted in FIGS. 7 and 8, respectively, the first conical surface segment 250A can have one, two, or more surface segments. The first conical half-angle $\theta_1$ can be between about 150 and 40°. The second conical half-angle $\theta_2$ can be between about 20° and 40°. The third conical half-angle $\theta_3$ can be between about 30° and 40°.

As shown in FIG. 7 and FIG. 8, the second venturi expansion surface portion 244B has a single conical surface segment 245 that forms a fourth conical half-angle $\theta_4$ relative to the longitudinal centerline axis 102 and the single conical surface segment 245 is formed as a unitary piece (e.g., made of a single material) that is selected to withstand combustion temperatures. The fourth conical half-angle $\theta_4$ can be between about 40° and 50°. However, the present disclosure is not limited to the foregoing ranges and other half-angles could be implemented instead. In an embodiment, as illustrated in FIG. 7, the single conical surface segment 245 of the second venturi expansion surface portion 244B is mechanically joined with the second conical surface segment 250B of the first venturi expansion surface portion 244A. For example, as shown in FIG. 7, an edge of the single conical surface segment 245 is mechanically joined (mated, soldered, brazed, etc.) with an edge of the second conical surface segment 250B. In an embodiment, as shown in FIG. 7, the single conical surface segment 245 of the second venturi expansion surface portion 244B has two ends. One edge is connected to the tip portion 248 of the vented pilot venturi 116 and an opposite edge is connected to an edge of the second conical surface segment 250B. In an embodiment, as depicted in FIG. 7, the single conical surface segment 245 of the second venturi expansion surface portion 244B can have a polygonal cross-sectional shape that is selected to allow for an increased number of rows of oxidizer outlet ports or holes in the single conical surface segment 245 of the second venturi expansion surface portion 244B. Although the second venturi expansion surface portion 244B is shown having a single conical surface segment 245, the second venturi expansion surface portion 244B can also have a plurality of conical surface segments.

In an embodiment, the first conical half-angle $\theta_1$ is less than the second conical half-angle $\theta_2$, the second conical half-angle $\theta_2$ is less than the third conical half-angle $\theta_3$, and the third conical half-angle $\theta_3$ is less than the fourth conical half-angle $\theta_4$ (i.e., $\theta_1<\theta_2<\theta_3<\theta_4$). In another embodiment, the first conical half-angle $\theta_1$ is less than the second conical half-angle $\theta_2$, the second conical half-angle $\theta_2$ is less than the third conical half-angle $\theta_3$, and the third conical half-angle $\theta_3$ is greater than the fourth conical half-angle $\theta_4$ (i.e., $\theta_1<\theta_2<\theta_3>\theta_4$). In another embodiment, the first conical half-angle $\theta_1$ is less than the second conical half-angle $\theta_2$, the second conical half-angle $\theta_2$ that is greater than the third conical half-angle $\theta_3$, and the third conical half-angle $\theta_3$ is less than the fourth conical half-angle $\theta_4$ (i.e., $\theta_1<\theta_2>\theta_3<\theta_4$). In another embodiment, the first conical half-angle $\theta_1$ is less than the second conical half-angle $\theta_2$, the second conical half-angle $\theta_2$ is greater than the third conical half-angle $\theta_3$, and the third conical half-angle $\theta_3$ is greater than the fourth conical half-angle $\theta_4$ (i.e., $\theta_1<\theta_2<\theta_3>\theta_4$). The angles of the segments can be advantageously selected to have a desired flow structure or to control the boundary layer of gas flow that is conducive to have an optimal lower gas temperatures on the venturi surfaces. In addition, the angles can be selected so as to provide a desired pilot aero volume and recirculation zone for improved flame stability.

As shown in FIGS. 7 and 8, the plurality of conical surface segments 250 are shown to be flat or linear. However, any one or more of the plurality of conical surface segments 250 can have a curved surface. For example, while the first conical surface segment 250A may be flat, the second conical surface segment 250B can have a curved surface.

As shown in FIG. 7, the vented pilot venturi 116 has a plurality of oxidizer outlet ports 262 that are distributed on the venturi expansion surface 244. The plurality of oxidizer outlet ports 262 can be provided on the first venturi expansion surface portion 244A and/or the second venturi expansion surface portion 244B of the venturi expansion surface 244. Alternatively, in another embodiment, any of the first venturi expansion surface portion 244A and/or the second venturi expansion surface 244B may not be provided with oxidizer outlet ports. In an embodiment, at least one row of oxidizer outlet ports 262 is provided through each segment (e.g., first venturi expansion surface portion 244A and the second venturi expansion surface portion 244B), or that one or more segments (e.g., the first venturi expansion surface portion 244A or the second venturi expansion surface portion 244B) may not have oxidizer outlet ports 262. The plurality of oxidizer outlet ports 262 provided on the venturi expansion surface 244 are not shown in FIG. 8 for clarity purposes only so as to more clearly show the first conical half-angle $\theta_1$, the second conical half-angle $\theta_2$, and the third conical half-angle $\theta_3$ of the plurality of conical surface segments 250, and the fourth conical half-angle $\theta_4$ of the single conical surface segment 245 of the second venturi expansion surface portion 244B.

In the embodiment shown in FIG. 7, a first plurality of oxidizer outlet ports 264 are arranged about the circumference of the first conical surface segment 250A, and a second plurality of oxidizer outlet ports 266 are arranged about the circumference of the second conical surface segment 250B. The first plurality of oxidizer outlet ports 264, arranged about the circumference of the first conical surface segment 250A, may be referred to as a first row of oxidizer outlet ports, and the second plurality of oxidizer outlet ports 266, arranged about the circumference of the second conical surface segment 250B may be referred to as a second row of oxidizer outlet ports. The first plurality of oxidizer outlet ports 264 can be arranged at a radial distance R1 from the longitudinal centerline axis 102, while the second plurality of oxidizer outlet ports 266 can be arranged at a radial distance R2 different from the radial distance R1 (e.g., radial distance R2 is greater than radial distance R1).

In an embodiment, a third plurality of oxidizer outlet ports 268 can be provided on the second venturi expansion surface portion 244B. As shown in FIG. 7, the third plurality of oxidizer outlet ports 268 are arranged about the circumference of the second venturi expansion surface portion 244B as a plurality of third rows of oxidizer outlet ports. The third plurality of oxidizer outlet ports 268 can be arranged at a radial distance R3 from the longitudinal centerline axis 102 that is greater than the radial distance R2 and the radial distance R1. In an embodiment, a number of rows of the third plurality of oxidizer outlet ports 268 provided on the second venturi expansion surface portion 244B (for example, four, as shown in FIG. 7) is greater than a number of rows of the first plurality of oxidizer outlet ports 264 arranged about the circumference of the first conical surface segment 250A (for example, one row, as shown in FIG. 7) and a number of rows of the second plurality of oxidizer outlet ports 266 arranged about the circumference of the second conical surface segment 250B (for example, two rows, as shown in FIG. 7) as the second venturi expansion surface portion 244B is subject to higher temperatures than the first conical surface segment 250A. In an embodiment, because the venturi surface area increases with an increase in radius ($2\cdot\pi\cdot r$) in an axial direction, the number of outlet ports is increased to achieve effective cooling of the venturi walls.

While the forgoing description was made with reference to one row of the first plurality of oxidizer outlet ports 264 about the circumference of the first conical surface segment 250A, and two rows of the second plurality of oxidizer outlet ports 266 about the circumference of the second conical surface segment 250B, for a total of three rows, the present disclosure is not limited to the three rows of the oxidizer outlet ports. More specifically, the number of rows of the oxidizer outlet ports may range from one row to ten rows of the oxidizer outlet ports. Similarly, the third plurality of oxidizer outlet ports 268 are arranged about the circumference of the second venturi expansion surface portion 244B as a plurality of third rows of oxidizer outlet ports that can be two rows or more (for example, four rows, as depicted in FIG. 7). The number of rows, however, is not limited to the foregoing and the number of rows can be selected based on a desired cooling effect to be achieved. In addition, one or more of the plurality of conical surface segments 250 (e.g., the first conical surface segment 250A and/or the second conical surface segment 250B) may also not have any oxidizer outlet ports.

Figure 9:
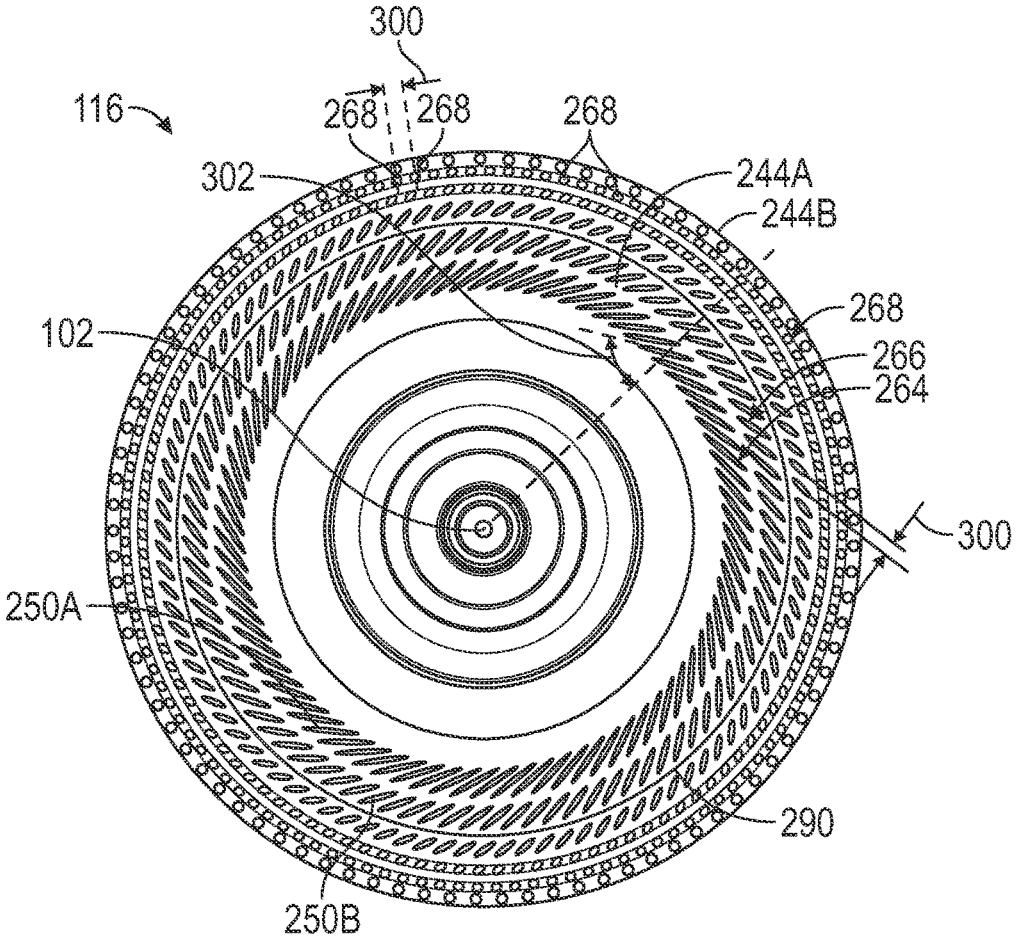
FIG. 9 is an aft, forward-looking view of a pilot fuel nozzle assembly, according to an embodiment of the present disclosure.

FIG. 9 is an aft, forward-looking view of a pilot fuel nozzle assembly, according to an aspect of the present disclosure. As shown in FIG. 9, the third plurality of oxidizer outlet ports 268 are spaced circumferentially about the circumference of the second venturi expansion surface portion 244B. The circumferential spacing 300 of the third plurality of oxidizer outlet ports 268 may be based on the size of the third plurality of oxidizer outlet ports 268. For example, the circumferential spacing 300 may be at least from twice an average diameter of the third plurality of oxidizer outlet ports 268, or up to six times the average diameter of the third plurality of oxidizer outlet ports 268. Here, the average diameter of the third plurality of oxidizer outlet ports 268 may be from 0.02 inches to 0.038 inches (or, roughly, 0.50 mm to 0.965 mm). The foregoing spacing and outlet port diameter size may also be applicable to the first plurality of oxidizer outlet ports 264 and the second plurality of oxidizer outlet ports 266. The spacing between the first plurality of oxidizer outlet ports 264, the second plurality of oxidizer outlet ports 266, or the third plurality of oxidizer outlet ports 268 can be the same or different. The circumferential spacing 300 between the first plurality of oxidizer outlet ports 264, between the second plurality of oxidizer outlet ports 266, or between the third plurality of oxidizer outlet ports 268 can be at least twice the average diameter, or up to six times an average diameter of an oxidizer outlet port. Of course, the spacing and the size of the outlet ports are not limited to the foregoing, and other spacing or port sizes may be implemented instead, depending on the cooling effect to be achieved. An interface edge 290 between the first venturi expansion surface portion 244A and the second venturi expansion surface portion 244B is shown in FIG. 9 as a circumferential line. The interface edge 290 corresponds to the breakpoint 246 (e.g., a joint point) shown in FIG. 7.

The first plurality of oxidizer outlet ports 264 that are arranged about the circumference of the first conical surface segment 250A, and/or the second plurality of oxidizer outlet ports 266 that are arranged about the circumference of the second conical surface segment 250B may also be arranged at an angle with respect to the circumferential direction (C) so as to provide a swirl of the air within the venturi. For example, the first plurality of oxidizer outlet ports 264 and/or the second plurality of oxidizer outlet ports 266 may be arranged at a co-swirl circumferential angle 302 so as to provide air flow in a co-swirl direction with respect to the pilot swirl direction. In one aspect, the co-swirl circumferential angle 302 may range from zero to sixty degrees. Of course, the co-swirl circumferential angle 302 is not limited to the foregoing range and other angles may be implemented instead, based on a desired swirl effect. In addition, while FIG. 9 depicts a single co-swirl circumferential angle 302 for the row of oxidizer outlet ports closest to the longitudinal centerline axis 102, the oxidizer outlet ports arranged in rows outward of the inner-most row may also be angled in the co-swirl direction.

The vented venturi described above provides for additional cooling of the outlet end of the venturi. The air flowing through the outlet ports is used for cooling the venturi walls. Air flowing through the outlet ports is not intended for mixing with fuel-air mixture coming out from the pilot. The vented venturi can be made of a single part or can be made of a number of segments that are joined together and arranged at various segment angles. Each segment may have a plurality of oxidizer outlet ports. One or more segments of the venturi is provided with a row of cooling oxidizer outlet ports. One or more segments of the venturi may also not have cooling oxidizer outlet ports. In an embodiment, the vented venturi can have an overall greater divergence angle to generate a larger recirculation zone for pilot flame stability. A divergence angle corresponds to the overall increase in angle from an inlet end of the venturi to an exit end of the venturi. A higher venturi angle results in a pilot flame being in closer proximity to a main flame encircling the main flame and, thus, promoting flame stability at fuel staged modes. With a higher discharge angle of venturi, the fuel-air mixture emanating from the pilot (i.e., pilot fuel-air mixture) comes in greater proximity to the main fuel-air mixer. The pilot fuel-air mixture and the main fuel-air mixture interact closely and thus improves flame stability.

While the foregoing description relates generally to a gas turbine engine, the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects are provided by the subject matter of the following clauses.

A pilot fuel nozzle assembly for a combustor of a gas turbine engine, the pilot fuel nozzle assembly including a pilot fuel nozzle defined about a fuel nozzle centerline axis, a pilot oxidizer inlet disposed near the pilot fuel nozzle, a pilot splitter arranged radially outward of the pilot fuel nozzle to define a pilot inner air passage between the pilot fuel nozzle and the pilot splitter, the pilot inner air passage being in fluid communication with the pilot oxidizer inlet, and a vented pilot venturi disposed radially outward of the pilot splitter and in fluid communication with the pilot oxidizer inlet to define a pilot outer air passage between the pilot splitter and the vented pilot venturi, the vented pilot venturi including, an annular wall extending circumferentially about the fuel nozzle centerline axis, and extending in a longitudinal direction along the fuel nozzle centerline axis from an inlet end of the vented pilot venturi to an outlet of the vented pilot venturi, the annular wall including an oxidizer flow passage within the annular wall, the oxidizer flow passage extending from the inlet end of the vented pilot venturi to an outlet end of the vented pilot venturi adjacent to the outlet, and the oxidizer flow passage being in fluid communication with the pilot oxidizer inlet. The annular wall defines an inner venturi surface defining an open cavity through the vented pilot venturi, the inner venturi surface including a throat area disposed between the inlet end of the vented pilot venturi and the outlet of the vented pilot venturi, the throat area having a diameter less than a remaining portion of the inner venturi surface downstream of the throat area, and a venturi expansion surface disposed, in the longitudinal direction, from the throat area to the outlet of the vented pilot venturi, the venturi expansion surface having a first diameter at the throat area and a second diameter at the outlet, the second diameter being greater than the first diameter. The venturi expansion surface comprises a plurality of conical surface segments extending circumferentially about the fuel nozzle centerline axis, and at least two conical surface segments are joined together mechanically, and one or more of the plurality of conical surface segments have a plurality of venturi oxidizer outlet ports extending from the oxidizer flow passage through the venturi expansion surface, and the plurality of venturi oxidizer outlet ports are circumferentially spaced about the fuel nozzle centerline axis.

The pilot fuel nozzle assembly of the preceding clause, wherein the plurality of conical surface segments are separate segment pieces that are joined together.

The pilot fuel nozzle assembly of any preceding clause, wherein the plurality of conical surface segments are made from a same material.

The pilot fuel nozzle assembly of any preceding clause, wherein two or more of the plurality of conical surface segments are made as a single unitary piece of a same material.

The pilot fuel nozzle assembly of any preceding clause, wherein the plurality of conical surface segments are angled relative to each other and angled relative to the fuel nozzle centerline axis.

The Pilot Fuel Nozzle Assembly of any Preceding Clause, Wherein One or More of the Plurality of Conical Surface Segments are Flat or Curved.

The pilot fuel nozzle assembly of any preceding clause, wherein each of the plurality of the plurality of venturi oxidizer outlet ports being arranged at an angle extending radially outward with respect to the fuel nozzle centerline axis.

The pilot fuel nozzle assembly of any preceding clause, wherein the plurality of venturi oxidizer outlet ports are arranged in a row circumferentially about the venturi expansion surface, and wherein a spacing, circumferentially, between each of the venturi oxidizer outlet ports in the row being in a range from twice an average diameter of the venturi oxidizer outlet ports to six times the average diameter of the venturi oxidizer outlet ports.

The pilot fuel nozzle assembly of any preceding clause, wherein the plurality of venturi oxidizer outlet ports are arranged at a co-swirl circumferential angle with respect to a circumferential direction about the fuel nozzle centerline axis, the co-swirl circumferential angle being in a range from zero degrees to sixty degrees, and the co-swirl circumferential angle being in a same direction as a pilot swirl direction of a pilot oxidizer swirler.

The pilot fuel nozzle assembly of any preceding clause, wherein the venturi expansion surface comprises a first venturi expansion surface portion and a second venturi expansion surface portion, wherein the first venturi expansion surface portion comprises a first conical surface segment and a second conical surface segment, the second conical surface segment being connected to the first conical surface segment, and the second venturi expansion surface portion comprises a single conical surface segment, wherein a first plurality of oxidizer outlet ports are arranged about a circumference of the first conical surface segment as a first row of oxidizer outlet ports, and a second plurality of oxidizer outlet ports are arranged about the circumference of the second conical surface segment as a second row of oxidizer outlet ports, wherein a third plurality of oxidizer outlet ports are arranged on the single conical surface segment of the second venturi expansion surface portion as a plurality of third row of oxidizer outlet ports, and wherein a number of rows of the third plurality of oxidizer outlet ports being greater than a number of rows of the first plurality of oxidizer outlet ports and greater than a number of rows of the second plurality of oxidizer outlet ports.

The pilot fuel nozzle assembly of any preceding clause, wherein the venturi expansion surface has a first venturi expansion surface portion and a second venturi expansion surface portion, the first venturi expansion surface portion extends from the throat area to a breakpoint along the venturi expansion surface, and the second venturi expansion surface portion extends from the breakpoint to a tip portion of the vented pilot venturi.

The pilot fuel nozzle assembly of any preceding clause, wherein the second venturi expansion surface portion has a single conical surface segment formed from a unitary material that being selected to withstand combustion temperatures.

The pilot fuel nozzle assembly of any preceding clause, wherein the first venturi expansion surface portion comprises a first conical surface segment, a second conical surface segment, and a third conical surface segment, the third conical surface segment being connected to the second conical surface segment and the second conical surface segment being connected to the first conical surface segment.

The pilot fuel nozzle assembly of any preceding clause, wherein the first conical surface segment defines a first conical half-angle $\theta_1$ relative to the fuel nozzle centerline axis, the second conical surface segment defines a second conical half-angle $\theta_2$ relative to the fuel nozzle centerline axis, and the third conical surface segment defines a third conical half-angle $\theta_3$ relative to the fuel nozzle centerline axis.

The pilot fuel nozzle assembly of any preceding clause, wherein the second venturi expansion surface portion has a single conical surface segment that defines a fourth conical half-angle $\theta_4$ relative to the fuel nozzle centerline axis, wherein the first conical half-angle $\theta_1$ being less than the second conical half-angle $\theta_2$, the second conical half-angle $\theta_2$ being less than the third conical half-angle $\theta_3$, and the third conical half-angle $\theta_3$ being less than the fourth conical half-angle $\theta_4$.

The pilot fuel nozzle assembly of any preceding clause, wherein the second venturi expansion surface portion has a single conical surface segment that defines a fourth conical half-angle $\theta_4$ relative to the fuel nozzle centerline axis, wherein the first conical half-angle $\theta_1$ being less than the second conical half-angle $\theta_2$, the second conical half-angle $\theta_2$ being less than the third conical half-angle $\theta_3$, and the third conical half-angle θ3 being greater than the fourth conical half-angle $\theta_4$.

The pilot fuel nozzle assembly of any preceding clause, wherein the second venturi expansion surface portion has a single conical surface segment that defines a fourth conical half-angle $\theta_4$ relative to the fuel nozzle centerline axis, wherein the first conical half-angle $\theta_1$ being less than the second conical half-angle $\theta_2$, the second conical half-angle $\theta_2$ being greater than the third conical half-angle $\theta_3$, and the third conical half-angle $\theta_3$ being less than the fourth conical half-angle $\theta_4$.

The pilot fuel nozzle assembly of any preceding clause, wherein the second venturi expansion surface portion has a single conical surface segment that defines a fourth conical half-angle $\theta_4$ relative to the fuel nozzle centerline axis, wherein the first conical half-angle $\theta_1$ being less than the second conical half-angle $\theta_2$, the second conical half-angle $\theta_2$ being greater than the third conical half-angle $\theta_3$, and the third conical half-angle $\theta_3$ being greater than the fourth conical half-angle $\theta_4$.

The pilot fuel nozzle assembly of any preceding clause, wherein the second venturi expansion surface portion has a single conical surface segment that defines a fourth conical half-angle $\theta_4$ relative to the fuel nozzle centerline axis, wherein the first conical half-angle $\theta_1$ being between 15° and 40°, the second conical half-angle $\theta_2$ being between 20° and 40°, the third conical half-angle $\theta_3$ being between 30° and 40°, and the fourth conical half-angle being between about 400 and 50°.

A turbine engine comprises a combustor having a pilot fuel nozzle assembly, the pilot fuel nozzle assembly including, a pilot fuel nozzle defined about a fuel nozzle centerline axis, a pilot oxidizer inlet disposed near the pilot fuel nozzle, a pilot splitter arranged radially outward of the pilot fuel nozzle to define a pilot inner air passage between the pilot fuel nozzle and the pilot splitter, the pilot inner air passage being in fluid communication with the pilot oxidizer inlet, and a vented pilot venturi disposed radially outward of the pilot splitter and in fluid communication with the pilot oxidizer inlet to define a pilot outer air passage between the pilot splitter and the vented pilot venturi, the vented pilot venturi including, an annular wall extending circumferentially about the fuel nozzle centerline axis, and extending in a longitudinal direction along the fuel nozzle centerline axis from an inlet end of the vented pilot venturi to an outlet of the vented pilot venturi, the annular wall including an oxidizer flow passage within the annular wall, the oxidizer flow passage extending from the inlet end of the vented pilot venturi to an outlet end of the vented pilot venturi adjacent to the outlet, and the oxidizer flow passage being in fluid communication with the pilot oxidizer inlet. The annular wall defines an inner venturi surface defining an open cavity through the vented pilot venturi, the inner venturi surface including, a throat area disposed between the inlet end of the vented pilot venturi and the outlet of the vented pilot venturi, the throat area having a diameter less than a remaining portion of the inner venturi surface downstream of the throat area, and a venturi expansion surface disposed, in the longitudinal direction, from the throat area to the outlet of the vented pilot venturi, the venturi expansion surface having a first diameter at the throat area and a second diameter at the outlet, the second diameter being greater than the first diameter. The venturi expansion surface comprises a plurality of conical surface segments extending circumferentially about the fuel nozzle centerline axis, and at least two conical surface segments are joined together mechanically, and one or more of the plurality of conical surface segments have a plurality of venturi oxidizer outlet ports extending from the oxidizer flow passage through the venturi expansion surface, and the plurality of venturi oxidizer outlet ports are circumferentially spaced about the fuel nozzle centerline axis.

Although the foregoing description is directed to the preferred embodiments of the present disclosure, other variations and modifications will be apparent to those skilled in the art and may be made without departing from the present disclosure. Moreover, features described in connection with one embodiment of the present disclosure may be used in conjunction with other embodiments, even if not explicitly stated above.

We claim:

1. A pilot fuel nozzle assembly for a combustor of a gas turbine engine, the pilot fuel nozzle assembly comprising:

a pilot fuel nozzle defined about a fuel nozzle centerline axis;

a pilot oxidizer inlet disposed near the pilot fuel nozzle;

a pilot splitter arranged radially outward of the pilot fuel nozzle to define a pilot inner air passage between the pilot fuel nozzle and the pilot splitter, the pilot inner air passage being in fluid communication with the pilot oxidizer inlet; and a vented pilot venturi disposed radially outward of the pilot splitter and in fluid communication with the pilot oxidizer inlet to define a pilot outer air passage between the pilot splitter and the vented pilot venturi, the vented pilot venturi comprising, an annular wall extending circumferentially about the fuel nozzle centerline axis, and extending in a longitudinal direction along the fuel nozzle centerline axis from an inlet end of the vented pilot venturi to an outlet of the vented pilot venturi, the annular wall comprising an oxidizer flow passage within the annular wall, the oxidizer flow passage extending from the inlet end of the vented pilot venturi to an outlet end of the vented pilot venturi adjacent to the outlet, and the oxidizer flow passage being in fluid communication with the pilot oxidizer inlet, wherein the annular wall defines an inner venturi surface defining an open cavity through the vented pilot venturi, the inner venturi surface comprising:

(a) a throat area disposed between the inlet end of the vented pilot venturi and the outlet of the vented pilot venturi, the throat area having a diameter less than a remaining portion of the inner venturi surface downstream of the throat area; and (b) a venturi expansion surface disposed, in the longitudinal direction, from the throat area to the outlet of the vented pilot venturi, the venturi expansion surface having a first diameter at the throat area and a second diameter at the outlet, the second diameter being greater than the first diameter, wherein the venturi expansion surface comprises a plurality of conical surface segments extending circumferentially about the fuel nozzle centerline axis, and at least two conical surface segments of the plurality of conical surface segments are joined together mechanically, and one or more of the plurality of conical surface segments have a plurality of venturi oxidizer outlet ports extending from the oxidizer flow passage through the venturi expansion surface, and the plurality of venturi oxidizer outlet ports are circumferentially spaced about the fuel nozzle centerline axis, and wherein the venturi expansion surface comprises a first venturi expansion surface portion and a second venturi expansion surface portion, wherein the first venturi expansion surface portion comprises a first conical surface segment and a second conical surface segment, the second conical surface segment being connected to the first conical surface segment, and the second venturi expansion surface portion comprises a single conical surface segment.

2. The pilot fuel nozzle assembly according to claim 1, wherein the plurality of conical surface segments of the venturi expansion surface are separate segment pieces that are joined together.

3. The pilot fuel nozzle assembly according to claim 1, wherein the plurality of conical surface segments are made from a same material.

4. The pilot fuel nozzle assembly according to claim 1, wherein two or more of the plurality of conical surface segments are made as a single unitary piece of a same material.

5. The pilot fuel nozzle assembly according to claim 1, wherein the plurality of conical surface segments are angled relative to each other and angled relative to the fuel nozzle centerline axis.

6. The pilot fuel nozzle assembly according to claim 1, wherein one or more of the plurality of conical surface segments are flat or curved.

7. The pilot fuel nozzle assembly according to claim 1, wherein each of the plurality of venturi oxidizer outlet ports is arranged at an angle extending radially outward with respect to the fuel nozzle centerline axis.

8. The pilot fuel nozzle assembly according to claim 1, wherein the plurality of venturi oxidizer outlet ports are arranged in a row circumferentially about the venturi expansion surface, and wherein a spacing, circumferentially, between each of the venturi oxidizer outlet ports in the row is in a range from twice a diameter of the venturi oxidizer outlet ports to six times the diameter of the venturi oxidizer outlet ports.

9. The pilot fuel nozzle assembly according to claim 1, wherein the plurality of venturi oxidizer outlet ports are arranged at a co-swirl circumferential angle with respect to a circumferential direction about the fuel nozzle centerline axis, the co-swirl circumferential angle being in a range from zero degrees to sixty degrees, and the co-swirl circumferential angle being in a same direction as a pilot swirl direction of a pilot oxidizer swirler.

10. The pilot fuel nozzle assembly according to claim 1, wherein a first plurality of oxidizer outlet ports are arranged about a circumference of the first conical surface segment as a first row of oxidizer outlet ports, and a second plurality of oxidizer outlet ports are arranged about a circumference of the second conical surface segment as a second row of oxidizer outlet ports, wherein a third plurality of oxidizer outlet ports are arranged on the single conical surface segment of the second venturi expansion surface portion as a plurality of third row of oxidizer outlet ports, and wherein a number of rows of the third plurality of oxidizer outlet ports is greater than a number of rows of the first plurality of oxidizer outlet ports and greater than a number of rows of the second plurality of oxidizer outlet ports.

11. The pilot fuel nozzle assembly according to claim 1, wherein the first venturi expansion surface portion extends from the throat area to a breakpoint along the venturi expansion surface, and the second venturi expansion surface portion extends from the breakpoint to a tip portion of the vented pilot venturi.

12. The pilot fuel nozzle assembly according to claim 11, wherein the single conical surface segment formed from a unitary material that is selected to withstand combustion temperatures.

13. The pilot fuel nozzle assembly according to claim 11, wherein the first venturi expansion surface portion comprises the first conical surface segment, the second conical surface segment, and a third conical surface segment, the third conical surface segment being connected to the second conical surface segment and the second conical surface segment being connected to the first conical surface segment.

14. The pilot fuel nozzle assembly according to claim 13, wherein the first conical surface segment defines a first conical half-angle $\theta_1$ relative to the fuel nozzle centerline axis, the second conical surface segment defines a second conical half-angle $\theta_2$ relative to the fuel nozzle centerline axis, and the third conical surface segment defines a third conical half-angle $\theta_3$ relative to the fuel nozzle centerline axis.

15. The pilot fuel nozzle assembly according to claim 14, wherein the single conical surface segment defines a fourth conical half-angle $\theta_4$ relative to the fuel nozzle centerline axis, wherein the first conical half-angle $\theta_1$ is less than the second conical half-angle $\theta_2$, the second conical half-angle $\theta_2$ is less than the third conical half-angle $\theta_3$, and the third conical half-angle $\theta_3$ is less than the fourth conical half-angle $\theta_4$.

16. The pilot fuel nozzle assembly according to claim 14, wherein the single conical surface segment defines a fourth conical half-angle $\theta_4$ relative to the fuel nozzle centerline axis, wherein the first conical half-angle $\theta_1$ is less than the second conical half-angle $\theta_2$, the second conical half-angle $\theta_2$ is less than the third conical half-angle $\theta_3$, and the third conical half-angle $\theta_3$ is greater than the fourth conical half-angle $\theta_4$.

17. The pilot fuel nozzle assembly according to claim 14, wherein the single conical surface segment defines a fourth conical half-angle $\theta_4$ relative to the fuel nozzle centerline axis, wherein the first conical half-angle $\theta_1$ is less than the second conical half-angle $\theta_2$, the second conical half-angle $\theta_2$ is greater than the third conical half-angle $\theta_3$, and the third conical half-angle $\theta_3$ is less than the fourth conical half-angle $\theta_4$.

18. The pilot fuel nozzle assembly according to claim 14, wherein the single conical surface segment defines a fourth conical half-angle $\theta_4$ relative to the fuel nozzle centerline axis, wherein the first conical half-angle $\theta_1$ is less than the second conical half-angle $\theta_2$, the second conical half-angle $\theta_2$ is greater than the third conical half-angle $\theta_3$, and the third conical half-angle $\theta_3$ is greater than the fourth conical half-angle $\theta_4$.

19. The pilot fuel nozzle assembly according to claim 14, wherein the single conical surface segment defines a fourth conical half-angle $\theta_4$ relative to the fuel nozzle centerline axis, wherein the first conical half-angle $\theta_1$ is between 15° and 40°, the second conical half-angle $\theta_2$ is between 20° and 40°, the third conical half-angle $\theta_3$ is between 30° and 40°, and the fourth conical half-angle $\theta_4$ is between 40° and 50°.

20. A turbine engine comprising:

a combustor having a pilot fuel nozzle assembly, the pilot fuel nozzle assembly comprising:

a pilot fuel nozzle defined about a fuel nozzle centerline axis;

a pilot oxidizer inlet disposed near the pilot fuel nozzle;

a pilot splitter arranged radially outward of the pilot fuel nozzle to define a pilot inner air passage between the pilot fuel nozzle and the pilot splitter, the pilot inner air passage being in fluid communication with the pilot oxidizer inlet; and a vented pilot venturi disposed radially outward of the pilot splitter and in fluid communication with the pilot oxidizer inlet to define a pilot outer air passage between the pilot splitter and the vented pilot venturi, the vented pilot venturi comprising, an annular wall extending circumferentially about the fuel nozzle centerline axis, and extending in a longitudinal direction along the fuel nozzle centerline axis from an inlet end of the vented pilot venturi to an outlet of the vented pilot venturi, the annular wall comprising an oxidizer flow passage within the annular wall, the oxidizer flow passage extending from the inlet end of the vented pilot venturi to an outlet end of the vented pilot venturi adjacent to the outlet, and the oxidizer flow passage being in fluid communication with the pilot oxidizer inlet, wherein the annular wall defines an inner venturi surface defining an open cavity through the vented pilot venturi, the inner venturi surface comprising:

(a) a throat area disposed between the inlet end of the vented pilot venturi and the outlet of the vented pilot venturi, the throat area having a diameter less than a remaining portion of the inner venturi surface downstream of the throat area; and (b) a venturi expansion surface disposed, in the longitudinal direction, from the throat area to the outlet of the vented pilot venturi, the venturi expansion surface having a first diameter at the throat area and a second diameter at the outlet, the second diameter being greater than the first diameter, wherein the venturi expansion surface comprises a plurality of conical surface segments extending circumferentially about the fuel nozzle centerline axis, and at least two conical surface segments are joined together mechanically, and one or more of the plurality of conical surface segments have a plurality of venturi oxidizer outlet ports extending from the oxidizer flow passage through the venturi expansion surface, and the plurality of venturi oxidizer outlet ports are circumferentially spaced about the fuel nozzle centerline axis, and wherein the venturi expansion surface comprises a first venturi expansion surface portion and a second venturi expansion surface portion, wherein the first venturi expansion surface portion comprises a first conical surface segment and a second conical surface segment, the second conical surface segment being connected to the first conical surface segment, and the second venturi expansion surface portion comprises a single conical surface segment.

* * * * *